United States Patent [19]

Delehouzee et al.

[11] Patent Number: 4,651,948

[45] Date of Patent: Mar. 24, 1987

[54] PACKAGE FOR A FRAGILE FILLED STRAND

[75] Inventors: Leon Delehouzee, Gentbrugge; Georges Knockaert, St. Amandsberg, both of Belgium

[73] Assignee: Trefilarbed Welding S.A., Gent, Belgium

[21] Appl. No.: 854,400

[22] Filed: Apr. 21, 1986

Related U.S. Application Data

[63] Continuation-in-part of Ser. No. 676,730, Nov. 3, 1984, abandoned.

[30] Foreign Application Priority Data

Dec. 1, 1983 [LU] Luxembourg ..... 85109

[51] Int. Cl.[4] ..... B65H 49/06

[52] U.S. Cl. ..... 242/129; 242/170

[58] Field of Search ..... 242/129, 128, 170, 171, 242/172, 159, 105, 77, 77.2

[56] References Cited

U.S. PATENT DOCUMENTS

| | | | |
|---|---|---|---|
| 2,197,180 | 4/1940 | Jenne et al. | 242/129 |
| 2,650,042 | 8/1953 | Markwood | 242/128 |
| 2,723,809 | 11/1955 | Vanderspek et al. | 242/128 |
| 2,935,274 | 5/1960 | Pearson | 242/128 |
| 3,118,634 | 1/1964 | Shumake | 242/129 |
| 3,186,659 | 6/1965 | Arnold | 242/129 |
| 3,218,002 | 11/1965 | Derrickson | 242/128 |
| 3,434,677 | 3/1969 | Hannis et al. | 242/128 |
| 3,491,967 | 1/1970 | Sawyer et al. | 242/129 |
| 4,471,651 | 9/1984 | Dimeff et al. | 242/129 X |
| 4,471,921 | 9/1984 | Corbin | 242/129 |

*Primary Examiner*—Stanley N. Gilreath

*Attorney, Agent, or Firm*—Karl F. Ross; Herbert Dubno

[57] ABSTRACT

A package has a toroidal coil of a filled wire generally centered on an axis and having axially oppositely directed end faces and radially oppositely directed inner and outer peripheries and a holder having one axial end lying against one end face of the coil, an outer structure engaging radially inward on the outer periphery of the coil, and an opposite axial end juxtaposed with the other end face of the coil. The opposite axial end is formed in part by a circular ring of a diameter smaller than that of the inner periphery and formed in turn with an inwardly open notch tapering in the direction the coil is wound. The holder is radially inwardly open so that the wire can be pulled from the inner periphery of the coil. Thus as each turn is pulled off the inner periphery it will be jarred slightly when passing the notch. This will loosen the turns from each other and will ensure that the wire feeds smoothly.

5 Claims, 4 Drawing Figures

PACKAGE FOR A FRAGILE FILLED STRAND

CROSS REFERENCE TO RELATED APPLICATION

This application is a continuation-in-part of copending application 676,730 filed Nov. 3, 1984, now abandoned.

FIELD OF THE INVENTION

The present invention relates to the packaging of a fragile strand. More particularly this invention concerns wire that is filled with smelting additives.

BACKGROUND OF THE INVENTION

It is standard to package smelting additives in a strand or wire so that the strand can be measured out and added to the molten charge being smelted. The filiform shape makes the material melt and mix well with the molten charge. It also facilitates measuring the chemicals since the content for a given unit of length is known, and deriving a given quantity is simply a method of dividing the quantity needed by the content per unit of length to obtain the length of the piece to be added to the melt.

The strand is formed of an outer skin shaped out of thin mild-steel strip stapled into a tubular shape and a core filled with a granular or pulverent dry particulate. The skin normally is about 0.4 mm thick for standard filled wire having a large diameter of 13 mm or 18 mm, but is only about 0.2 mm thick for thinner filled wires having a small diameter of 5 mm, 7 mm, or 9 mm. The additive core of the strand is typically aluminum, calcium, nickel, titanium, or alloys such as SiCa, SiCaBa, and SiZr, and serves to increase the deoxidation/desulfurization effectiveness of an alloying operation. Regardless of size, such a wire is a stiff and heavy item that is nonetheless relatively fragile.

The wire must be packaged so that an automatic apparatus can pay it out automatically at a high or low speed and so that it can stop the advance of the wire surely, all without damaging it. Hence it is standard to wind the wire up on wide-flange spools that can hold it in a neatly coiled toroidal shape centered on the axis of the spool. Such spools must be very robust due to the density and fragility of the strand. They are made of wood, sheet metal, or of heavy wire and normally form when full a package having an overall weight of a ton for large-diameter wire or about 150 kg for small-diameter wire.

Such a spool is normally mounted on a shaft for rotation about a horizontal axis by an automatic apparatus which pulls off the desired quantity of wire. This device comprises a brake for the spool so that when the desired quantity of wire has been payed out, the spool's rotation can be stopped. For accurate dosing of the additive it is therefore necessary to control the equipment that pays out and cuts off the payed-out strand very accurately, so that the spool rotation must be stopped rapidly. The rotation speed of the spool must be fairly high for efficient operation, so that the starting and stopping of the rotation of the wire-carrying spool is fairly abrupt.

Since a small 150 kg spool can be used up in two batches, it is standard nowadays to use the larger spools weighing about 1 ton. This increase in size increases the problems of handling the wire. As a result rupture of the fairly fragile wire is common.

It has therefore been suggested to set the spool on its end and to pull the wire axially up off it, without letting the spool rotate. This solution obviously reduces the above-discussed drive problems. Nonetheless, for each turn of the coil that is pulled off the spool the wire is twisted one turn on itself, something that normally does not excessively strain the wire at high speeds.

The turns of the wire that are pulled off from immediately adjacent the upper flange of the spool are subjected to considerable abrasion as they pass radially out and then bend axially up past the edge of this flange. Since the wire is being twisted at the same time as it is being scraped over this edge, chances of breakage are considerable. Thus it is known to mount a guide eye on the outer end of an arm having an inner end pivoted at the spool axis, so that engagement of the wire with the upper spool flange is avoided. Such structure, however, is relatively complex and frequently the wire jumps out of the eye when the wire starts or stops.

In the wire-feeding art it is known, for instance from U.S. Pat. No. 2,935,274 of Pearson to provide a fitting which sits atop a standard spool of wire and which carries a ring that is held so that it lies below the upper flange of the spool. Thus the wire can be pulled generally tangentially off the spool, then axially up and over the ring so that it does not contact the rough spool edge. Such an arrangement relies on contact between the wire and a stationary object in passing the wire out and then in over this ring, and can damage a powder-filled wire of the type the instant invention is aimed at feeding.

Similarly, in U.S. Pat. No. 3,434,677 an arrangement is provided which has a ring like that of the Pearson system, but set up so as to rotate about the spool axis, and carrying two angularly oppositely directed guide sheaves. The wire that is payed off the spool catches in one or the other sheaves, depending on the direction it is moving in, and then can roll up and out. Although such an arrangement is fairly gentle, it is a fairly complex piece of equipment which is used with different spools. Thus the spools must be loaded into the unwinding device so that setup time is considerable.

In the textile arts guide rings are also known. For instance in U.S. Pat. No. 2,650,042 of Markwood a ring is shown having a pinch arrangement that catches and breaks a yarn moving in the wrong direction. Otherwise this system has a stationary ring like the Pearson device. Similarly, in U.S. Pat. No. 2,723,809 of Vanderspek a loose skein of yarn is held in a device which pulls the yarn over a stationary ring, then axially through the center of the skein and radially away. Such a system would be unworkable with a heavy filament such as the one the instant invention deals with.

Another problem faced by a filled strand is that the turns of the coil tend to stick together somewhat. The individual turns are very massive and are often used in somewhat dirty environments, so that they can adhere to one another in part from the effects of rust and in part just because the soft strand compacts together somewhat. Thus when unwinding it is necessary to separate the turns from one another rather carefully, but gently, to prevent several turns from catching together, kinking, and jamming the machine.

OBJECTS OF THE INVENTION

It is therefore an object of the present invention to provide an improved fragile wire package.

Another object is the provision of such a package that can be unwound without the above-given disadvantages, that is with a minimal amount of extra equipment and with minimum violence to the wire.

A further object is to provide an improved package for such a filled wire so that it can be unwound directly from the transport package and that ensures that the turns of the wire will not stick together as they are unwound.

SUMMARY OF THE INVENTION

A package according to the invention has a toroidal coil of a filled wire generally centered on an axis and a holder having one axial end lying against one end face of the coil, an outer structure engaging radially inward on the outer periphery of the coil, and an opposite axial end juxtaposed with the other end face of the coil. The opposite axial end is formed in part by a circular ring of a diameter smaller than that of the inner periphery and formed in turn with an inwardly open notch tapering in the direction the coil is wound. The holder is radially inwardly open so that the wire can be pulled from the inner periphery of the coil.

Thus as each turn is pulled off the inner periphery it will be jarred slightly when passing the notch. This will serve to loosen the turns from each other and will ensure that the wire feeds smoothly.

According to a further feature of the invention the opposite end of the holder is formed at the inner periphery of the coil with an eye open axially toward the coil. In addition the coil has an outer end extending within the holder from the outer coil periphery and through the eye. This makes it extremely easy to connect this outer end to the leading end of the next coil for continuous feed of the wire from one coil to the next.

The notch of this invention is wedge shaped and has a flank extending as a spiral to the axis and a flank extending generally radially of the axis. Relative to the direction the wire travels as it is unwound, which corresponds to the winding direction from the outside outer end to the inner end, the steep radial flank is upstream of the spiral flank. Thus as the wire pulls out it will drop down in the notch and then ride smoothly up therein.

To facilitate joining the trailing end of one such package to the leading end of another, the package is furnished with a malleable tube fittable over one of the ends of the coil and lockingly engageable with the opposite end of an other such coil. This tube is crimped over these ends to secure them solidly enough together to ensure smooth feeding. The trailing end is effectively shielded in the corner of the notch, being jumped by the wire as it is pulled out and moves around the inside of the holder, so that it is not likely to be damaged.

For most inexpensive manufacture the outer structure is a plurality of axially extending rods angularly equispaced about the axis and the one end is a plurality of diametral rods extending between the axial rods. Thus the holder is in effect a basket containing the coil.

DESCRIPTION OF THE DRAWING

The above and other features and advantages will become more readily apparent from the following, reference being made to the accompanying drawing in which.

SPECIFIC DESCRIPTION

Figure 1:
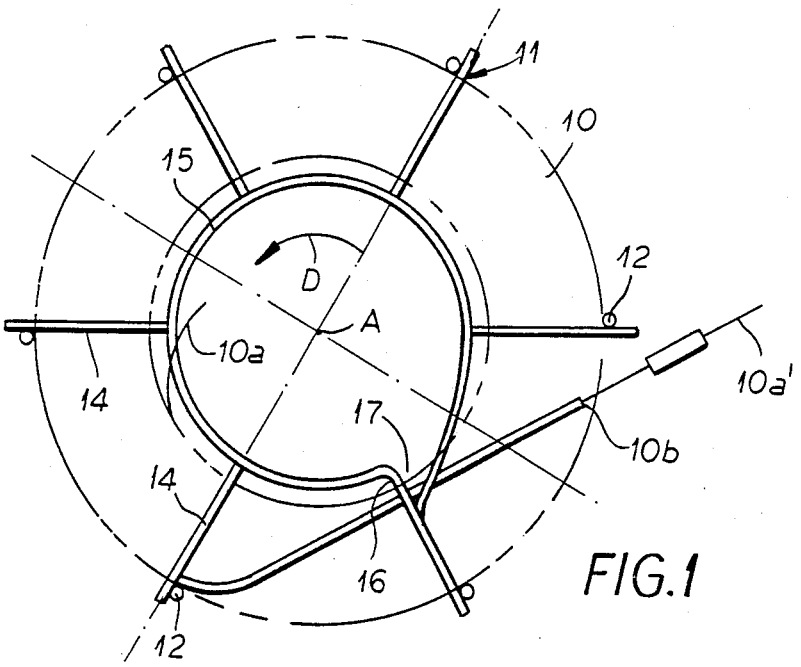
FIG. 1 is a top view of a spool according to this invention.
Figure 3:
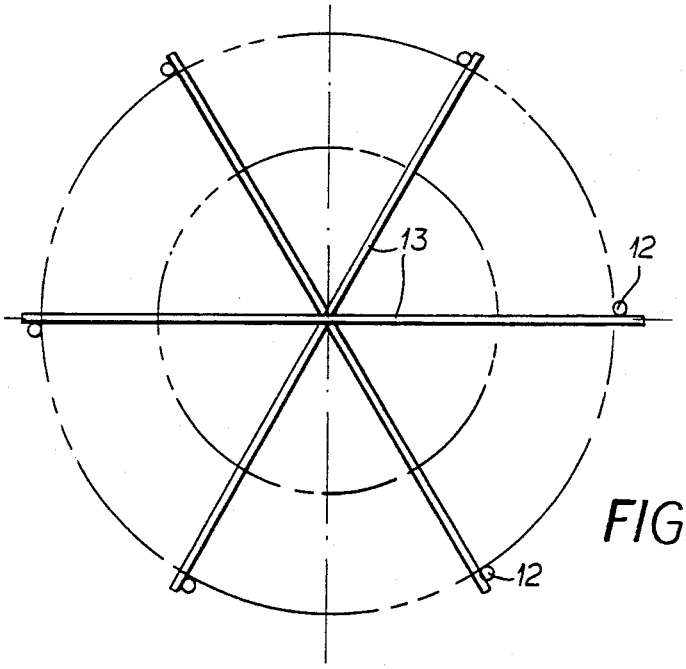
FIG. 3 is a bottom view of the spool.
Figure 2:
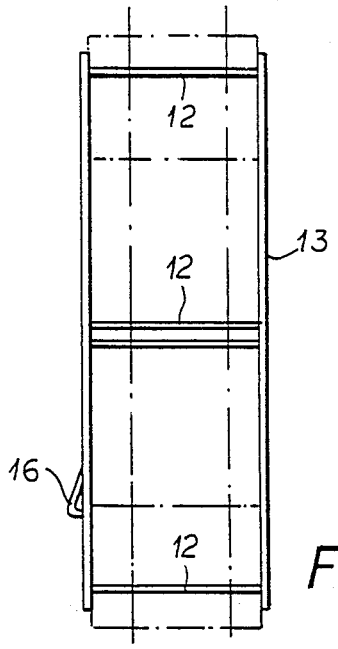
FIG. 2 is a side view of the spool.

As seen in FIG. 1 an annular coil 10 of wire has a leading end 10*a* projecting generally tangentially and clockwise from its inner periphery and a trailing end 10*b* extending generally tangentially and counterclockwise from its outer periphery. The coil 10 is of generally square section and the wire is formed, as described above, of a mild-steel tube filled with a granular smelting additive.

The coil 10 is contained in a holder indicated generally at 11 and formed of heavy steel rod, welded together into a single integral assembly. More particularly, the holder 1 comprises six parallel outer rods 12 extending parallel to the axis A on which the coil 10 and holder 11 are centered and angularly equispaced about this axis A. The lower ends of the rods 12 are welded to three diametral rods 13 that cross at the axis A where they are welded together. Extending radially inward from the upper end of five of the rods 12 is a respective short rod 14 having an inner end welded to a mainly circular ring 15 generally centered on the axis A.

At and between these five rods 14 the ring 15 extends perfectly circularly, centered on the axis A and lying radially inward of the inner periphery of the wire coil. One end of the ring 15 is bent axially up and radially out to form an eye 16, and then axially down and radially out to join with the sixth axial rod 12. The trailing end 10*b* of the wire passes radially around the coil 10 and then spirals inward over the axial end of the coil 10 to pass under this eye 16. The opposite end of the ring 15 is bent radially somewhat outward to form an inwardly open recess or notch 17 which, relative to the circle of the rest of the ring 15, increases in radial dimension in an angular direction opposite the direction D that the wire is pulled from the coil 10. Thus this formation 17 forms a discontinuity in the perfectly circular path otherwise formed by the ring 15.

The wire is pulled from the coil 10 starting from its inner end 10*a* in the manner described in detail in the above-cited parent application. As it is pulled out it slides over the rounded surface of the ring 15 and orbits about in this ring 15. Thus once each turn the wire will slip suddenly radially outward and land on the deepest part of the notch 17, thereby momentarily increasing and then decreasing the tension in the wire so as to jar the entire coil somewhat. This action is enough to unstick the innermost turns from one other so that they feed smoothly out of the coil 10. The sudden increase in tension as the wire falls off the upstream end of the notch 17 takes place just at the time when the wire is out of contact with the basket, so that the chance of rupture at this time is minimal.

Figure 4:
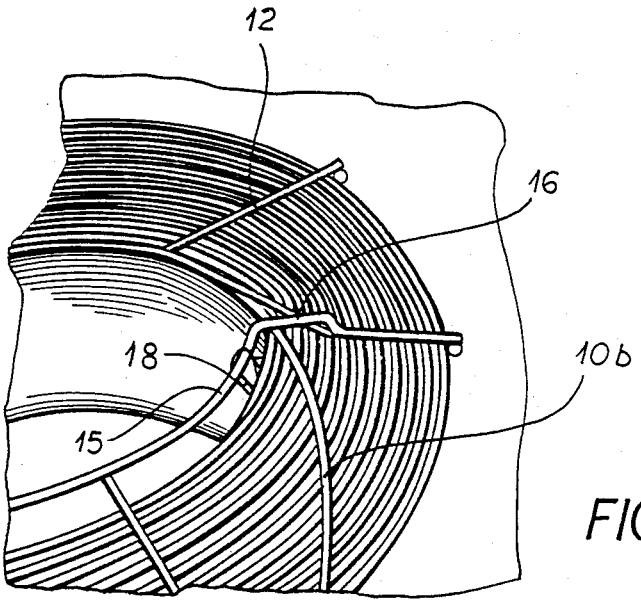
FIG. 4 is a perspective view of a detail of the instant invention.

The trailing end 10*b* is secured by a malleable-metal tube 18 to the leading end 10*a* of an adjacent coil that is not illustrated here. This tube 18 is of a metal like copper that will not affect the smelting operation. One such tube 18 is wired as indicated in FIG. 4 to each holder 11 and is simply crimped on the trailing end 10*b* of one coil 10 and on the leading end 10*a* of the next coil to allow continuous feed. Thus the coils are placed right against one another, with the axes parallel and normally vertical for small supplies and horizontal for large ones. Since the amount of wire on each holder 11 is substantial there is therefore plenty of time while one or two such coils are being used to dispense with an empty holder 11, which can be so inexpensively made that it can simply be discarded or thrown in with scrap being smelted, and a fresh supply is attached, and in fact four or more such supplies can be thus connected to feed continuously if space permits.

We claim:

1. A package comprising:

a toroidal coil of a filled wire generally centered on an axis and having axially oppositely directed end faces and radially oppositely directed inner and outer peripheries; and a holder having one axial end lying against one end face of the coil, an outer structure engaging radially inward on the outer periphery of the coil, and an opposite axial end juxtaposed with the other end face of the coil, the opposite axial end being formed in part by a circular ring of a diameter smaller than that of the inner periphery and formed in turn with an inwardly open notch tapering in the direction the coil is wound, the holder being radially inwardly open, whereby the wire can be pulled from the inner periphery of the coil.

2. The package defined in claim 1 wherein the opposite end of the holder is formed at the inner periphery of the coil with an eye open axially toward the coil, the coil having an outer end extending within the holder from the outer coil periphery and through the eye.

3. The package defined in claim 1 wherein the notch is wedge shaped and has a flank extending as a spiral to the axis and a flank extending generally radially of the axis.

4. The package defined in claim 1 wherein the coil has a leading end and a trailing end, the package further comprising a malleable tube fittable over one of the ends of the coil and lockingly engageable with the opposite end of an other such coil.

5. The package defined in claim 1 wherein the outer structure is a plurality of axially extending rods angularly equispaced about the axis and the one end is a plurality of diametral rods extending between the axial rods.

* * * * *